US006182459B1

(12) United States Patent
Hertel

(10) Patent No.: US 6,182,459 B1
(45) Date of Patent: Feb. 6, 2001

(54) REFRIGERATED CASE FOR FOOD PRODUCTS

(76) Inventor: Günther Hertel, Mörikstrasse 24, D-90491 Nürnberg (DE)

( * ) Notice: Under 35 U.S.C. 154(b), the term of this patent shall be extended for 0 days.

(21) Appl. No.: 09/168,898

(22) Filed: Oct. 9, 1998

(51) Int. Cl.[7] ..... A47F 3/04
(52) U.S. Cl. ..... 62/255
(58) Field of Search ..... 62/255, 256, 249, 62/246; 454/193

(56) References Cited

U.S. PATENT DOCUMENTS 3,119,241 * 1/1964 Wile ..... 62/256
4,651,536 * 3/1987 Nax ..... 62/256

FOREIGN PATENT DOCUMENTS 83 16 262 3/1984 (DE) .
93 16 571 2/1994 (DE) .

* cited by examiner

*Primary Examiner*—William E. Tapolcai
(74) *Attorney, Agent, or Firm*—Venable; Gabor J. Kelemen

(57) ABSTRACT

In a refrigerated case for food products, having a display surface and a cool-air current that circulates around the display surface, the air current flows through a filter for filtering out airborne particles, bacteria and the like. The filter covers the clear cross section of the exit opening of a circulation channel.

14 Claims, 4 Drawing Sheets

4
5
6
7
3
10
9
11
12
2
19
20a
7
18
17
21
16
7
14
20
15
1

REFRIGERATED CASE FOR FOOD PRODUCTS

BACKGROUND OF THE INVENTION

The invention relates to a refrigerated case for highly-perishable food products, particularly meats. This type of case includes a display surface provided with a circulating current of cooled air. The air current is guided forward, via a circulation channel, across the display surface from the rear side of the case and back to the rear side, where it exits through an exit opening of the circulation channel that extends essentially over the case width and above the rear edge of the display surface.

A case of this type is known from, for example, G 83 16 262.3. In this case, a fan that sucks the air from the customer side of the case and blows it into the space surrounding the display surface via an exit opening on the service side is disposed in the floor space below the display surface. To filter airborne particles, etc., out of the circulating air, a hygienic filter is disposed in a downward-leading fall shaft on the customer side of the display surface. Despite this filter, microorganisms such as bacteria, fungus spores and the like inevitably collect and proliferate in the floor space, which constitutes a portion of the circulation channel, as well as in the remainder of the circulation channel. These microorganisms can then reach the display surface, unfiltered, with the air current. The fact that case devices, specifically a vaporizer and a fan, which are easily contaminated and are thus breeding grounds for microorganisms, are disposed in the floor space in the known case—a relatively inaccessible location—further promotes the proliferation of microorganisms in the floor space.

SUMMARY OF THE INVENTION

It is the object of the invention to improve a refrigerated case for food products of the aforementioned type with respect to hygiene. The solution to this object lies in a filter for filtering out airborne particles, bacteria and the like, the filter being flowed through by the circulating air current and being disposed in the exit opening of the circulation channel, completely covering the clear cross section of the channel. This arrangement ensures that the air that enters the space containing the products is essentially free of airborne particles, bacteria and the like. In any event, the air contains fewer such particles than when the circulated air flows through the entire space below the display surface and the adjoining section of the circulation channel, in which case the air can be infiltrated by microorganisms, particularly in the region of the vaporizer, a known breeding ground for microorganisms. A further, essential advantage is that the fan can practically be disposed in the immediate vicinity of the exit opening, upstream behind the filter. A slow and uniform circulating-air current is desirable in refrigerated cases for food products. For this reason, in the known refrigerated case, the fan is disposed relatively far from the exit opening, particularly in the floor space beneath the display surface, to avoid air swirling and local differences in air currents. A filter arranged in accordance with the invention thus has an air-purifying effect and simultaneously acts as an air-baffling element, ensuring a slow, uniform air current. Normally, a vaporizer is also disposed in the floor space, which is problematic in terms of hygiene, especially with inconsistent cleaning intervals, which is not infrequently the case.

In contrast, in the filter arrangement of the invention, it is easily possible to clean the fan behind the filter. To this end, the filter merely needs to be detachably, particularly pivotally, secured in the exit opening. It is further advantageous if the fan can pivot out of the exit opening about a pivoting axis that extends in the longitudinal direction of the case. Then the rear side of the fan can also be easily cleaned. It is also advantageous for the fan to be pivotable in this manner if—seen in the flow direction—the vaporizer is located directly behind the fan, so the vaporizer can be easily cleaned with suitable cleaning tools such as long-handled brushes, significantly lowering the inhibitory threshold for a thorough cleaning of the regions that are problematic in terms of hygiene.

BRIEF DESCRIPTION OF THE DRAWINGS

The invention is described in detail by way of embodiments illustrated in the figures.

DETAILED DESCRIPTION OF THE PREFERRED EMBODIMENTS

Figure 1:
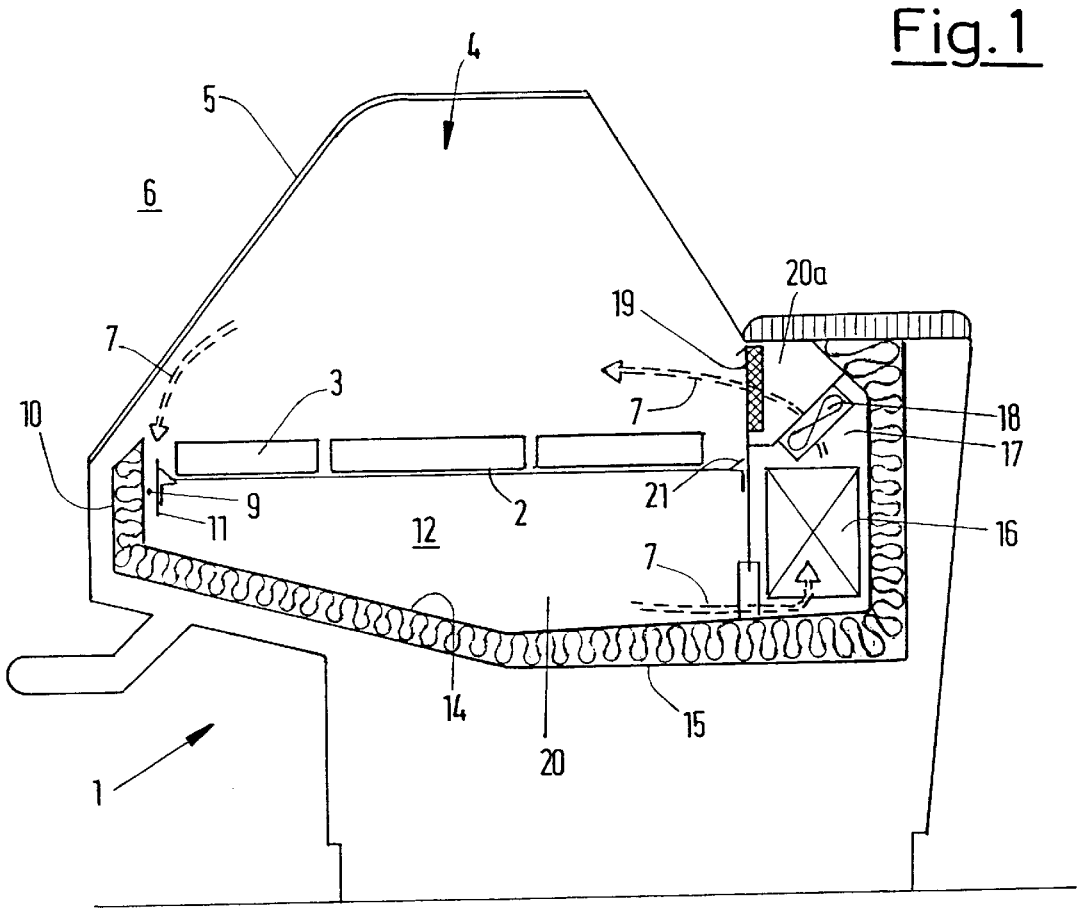
FIG. 1 is a cross-sectional representation of the case with arrows indicating the flow direction of the air current surrounding the display surface.

The case body 1 contains an essentially horizontal display surface 2 for holding a product 3, which is represented schematically here by a spatial body. The product-housing space 4 above the display surface 2 is encased by an upwardly-pivotable glass display canopy 5, only shown schematically here. The consumer views the product 3 in the product-housing space 4 from the front side 6.

A current of cooled air circulates in the flow direction 7 around the display surface 2, embodied here as a horizontal platform for holding the product 3. The current is effected from the service side 8 of the case, in the direction of the front side 6, and across the display surface 2, in other words, the product 3 lying on the surface. There the air current is diverted downward by the glass display canopy 5, or is sucked up and supplied to the fall shaft 9 in the floor space 12 between the front wall 10 and a parallel, vertical wall surface 11 adjoining the display surface 2. The floor space 12 is contained between the display surface 2 and the floor 14, and the air current is also guided laterally beneath the display surface 2 from the case tub 15. The circulating air exiting the floor space 12 is supplied to a cooling assembly, which is primarily formed by a vaporizer 16. The vaporizer 16 is located behind the floor space 12 in an ascent shaft 17, which represents the end region of the circulation channel 20 formed by the fall shaft 9, floor space 12 and ascent shaft 17. The circulating air ascends through the ascent shaft 17 or end region, and completes the described air-circulation cycle. A fan 18 is positioned above the vaporizer 16. This fan provides the drive for the air circulation. Its blowing direction is oriented diagonally upward.

A filter 19 for filtering out airborne particles, bacteria and the like is located behind the fan 18 in the flow direction, that is, upstream, in the exit opening 20*a* of the circulation channel 20. The filter 19 is acted upon by circulating air that is forced out of the fan 18 and baffled in front of the filter 19, and therefore distributed uniformly over the entire filter surface. An overpressure dominates in the region of the exit opening 20*a* in front of the filter 19. The filter 19 covers the clear cross section of the exit opening 20*a*, so that, on the one hand, only filtered air, and particularly air containing essentially no microorganisms, can enter the region of the product-housing space 4, and on the other hand, a uniform, slowed air current is effected.

The exit opening 20*a* has the cross-section shape of a rectangle lying down. It is disposed above the rear edge 21 of the display surface 2, and extends basically parallel to the display surface 2.

Figure 2:
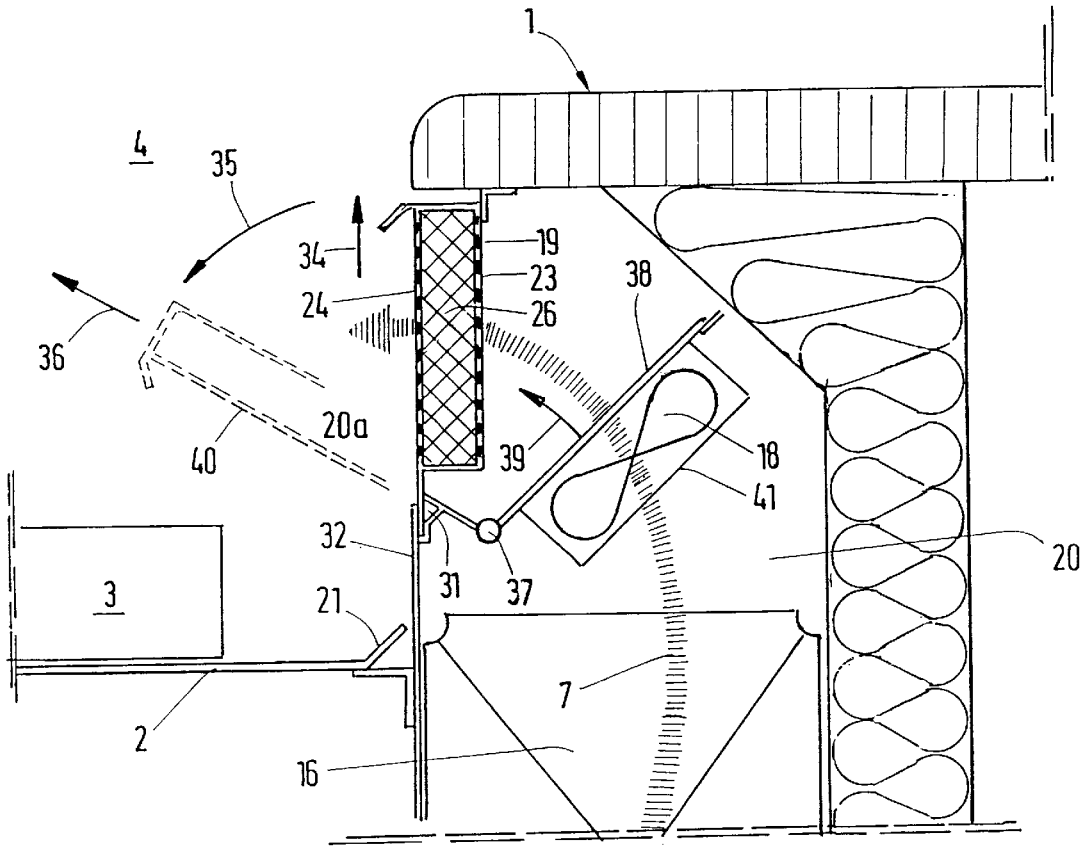
FIG. 2 is an enlarged, detailed representation of region II of FIG. 1.
Figure 3:
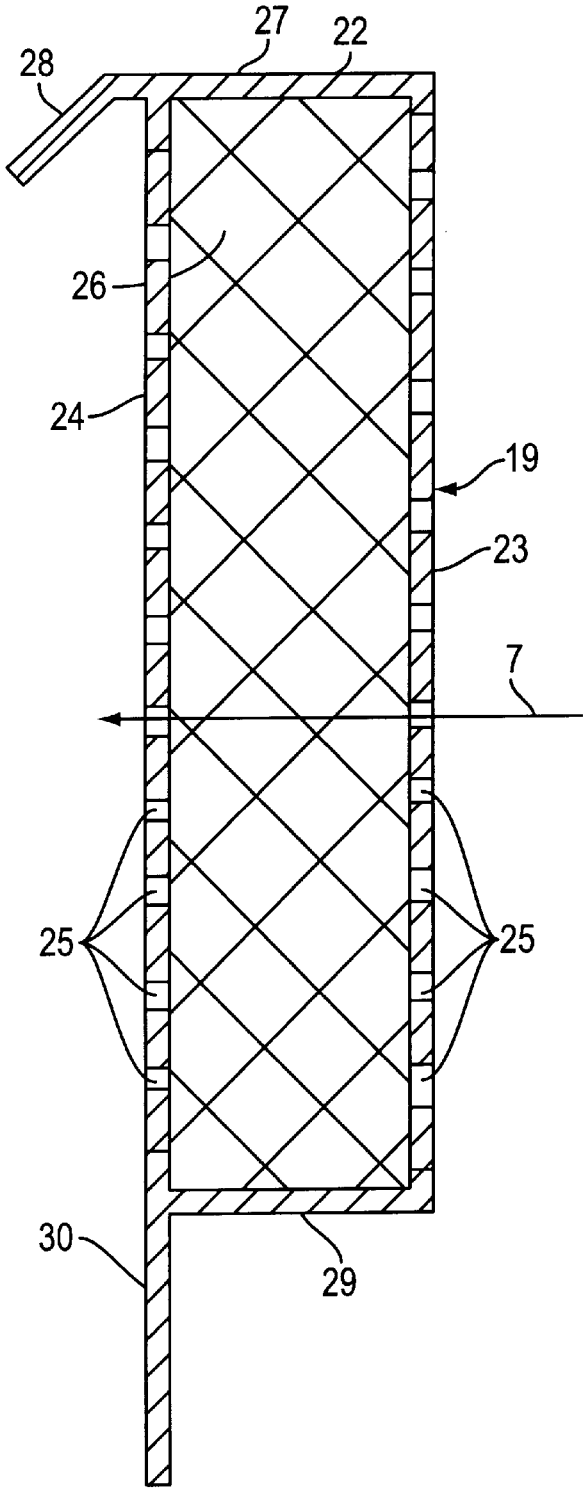
FIG. 3 is an enlarged, cross-sectional representation of the filter.
Figure 4:
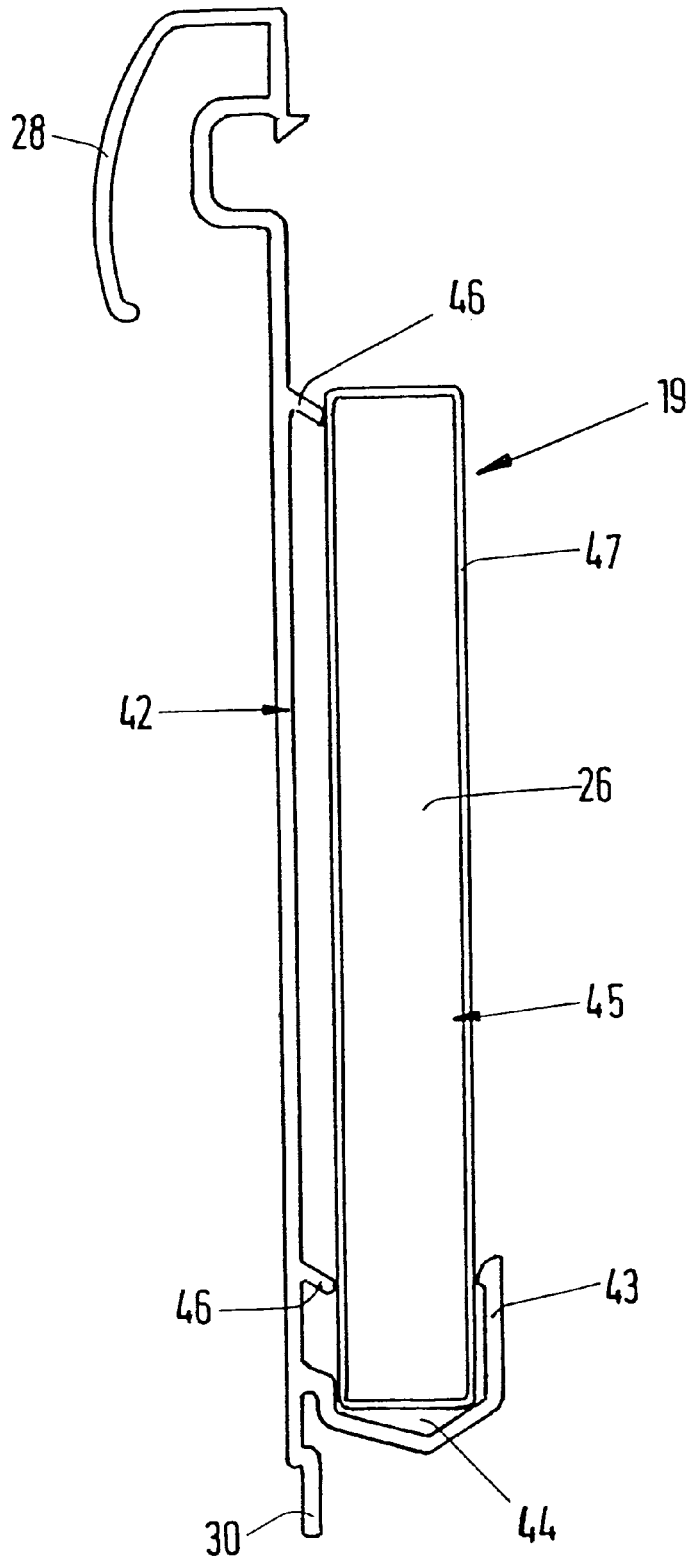
FIG. 4 is an alternative filter embodiment.

The filter 19 is disposed in a hollow profile 22 that covers the exit opening 20*a* and has a uniform cross-section shape over the case width. The longitudinal axis of the hollow profile 22 extends in the direction of the longitudinal extension of the case width, and therefore perpendicular to the drawing planes of FIGS. 1 through 3. The hollow profile 22 includes two parallel flank walls 23, 24. The two flank walls 23, 24 are provided with perforations 25 for permitting a flow-through. The hollow profile 22 forms the casing for the filter material 26. The two hollow profiles are closed by a cap or plug (not shown). The filter material 26 can be cleaned. For this purpose, the filter 19 can easily be released from its filter position (FIGS. 1, 2) and removed from the case body 1. In the assembled position, the hollow profile 22 has the cross-section shape of a standing rectangle, and the flank walls 23, 24 provided with perforations 25 are the longer rectangle sides. A gripping tab 28 adjoins the upper end 27 of the flank wall facing the product-housing space 4. The gripping tab 28 is produced in one piece with the hollow profile 22 embodied as an extruded profile, with the extrusion direction and the longitudinal axis of the hollow profile extending perpendicular to the drawing planes of FIGS. 1 through 3. A downward-protruding lowering rib 30 adjoins the lower end 29 of the front-side flank wall 24 of the hollow profile 22. In the closed position (FIGS. 1, 2), the lowering rib 30 serves in effecting a form-fit in a receiving groove 31 on the case frame 32, the groove forming the part of a lifting-lowering closure. In the closed position, the filter 19 rests against a support tab 33 of the case body 1. To release the filter 19, the filter is first lifted by its gripping tab 28 in arrow direction 34, then pivoted counterclockwise downward in arrow direction 35, whereupon it assumes the pivoted position shown as dashed lines in FIG. 2, and is then removed from the receiving groove 31 of the case frame 32 in arrow direction 36, that is, it is removed from the case body 1. The filter is re-inserted in the opposite sequence. FIG. 4 shows an alternative embodiment of a filter 19. This filter encompasses a carrier 42, which is perforated to permit an air flow-through. The gripping tab 28 is formed onto the carrier's upper edge in the assembled state. The lowering rib 30 forms the lower edge of the carrier, which basically has the shape of a rectangle lying down. A C-shaped carrier arm 43—when seen in section transverse to the longitudinal direction of the case—which forms a receiving groove 44, is formed on above the lowering rib 30. A filter element 45 is inserted by its lower edge region into this receiving groove 44. Spacers 46, against which the filter element 45 is supported, are formed onto the side of the carrier 42 facing the circulation channel 20. The filter material 26 of the filter element is basically completely encompassed by a perforated casing 47. The filter element 45 is divided into a plurality of partial elements in the longitudinal direction of the case. To clean the filter 19, the carrier 42 is pivoted out of its closed position with the aid of the gripping tab 28, and the filter element 45 or its individual partial elements can then be removed easily from the receiving groove 44 and cleaned.

When the filter 19 is removed, the fan 18 is accessible. The fan 18 is secured to a carrier 38, which is seated to pivot about a pivoting axis 37 at its edge facing the product space 4. The pivoting axis 37 extends in the longitudinal direction of the case. When the filter 19 is removed, the fan 19 can be pivoted out of the exit opening 20*a* in arrow direction 39. The fan then roughly assumes a position 40 that corresponds to that of the filter 19 that is now pivoted out of the exit opening 20*a*. The fan rear side 41 is then readily accessible, and can consequently be cleaned thoroughly. When the fan 18 is in the position 40, the vaporizer 16 or another cooling assembly used for cooling is accessible, and can undergo a thorough cleaning.

A display for determining the filter cleaning time could be realized by an overpressure sensor with sensing elements in the circulation channel, or by an oxygen-content sensor.

What is claimed is:

1. A refrigerated case for highly perishable food products, comprising:

a display surface having a rear edge;

a circulation channel extending below the display surface and substantially across a width of the display surface for guiding an air current from a rear side of the case to a front side of the case, the circulation channel having a rear end region, and an exit opening disposed above the rear edge of the display surface;

a cooling unit located in the circulation channel for cooling the air current; and a filter located substantially across the exit opening to filter the air current after the air current exits the cooling unit.

2. The refrigerated case according to claim 1, wherein the filter is detachably secured.

3. The refrigerated case according to claim 2, wherein the filter includes a carrier which covers the exit opening and holds at least one of a filter material and at least one filter elements, and is provided with a perforation for permitting a flow-through of the air current.

4. The refrigerated case according to claim 3, comprising a case frame having a receiving groove, wherein a lowering rib is attached to a lower end of the carrier which effects a form-fit in the receiving groove on the case frame to form a a lifting-lowering closure between the rib and the groove.

5. The refrigerated case according to claim 4, wherein the receiving groove permits the filter to pivot and lift to detach the filter from the case frame.

6. The refrigerated case according to claim 3, wherein the carrier has a hollow profile with a filter material inside the hollow profile.

7. The refrigerated case according to claim 6, wherein the hollow profile of the carrier has an upright-rectangular cross-section shape, with the longer sides of the rectangle being perforated.

8. The refrigerated case according to claim 3, wherein the carrier holds at least one filter element and had a receiving groove that extends in a longitudinal direction of the case, and in which the lower end of the at least one filter element is positioned.

9. The refrigerated case according to claim 3, wherein the carrier has an aluminum extruded profile.

10. The refrigerated case according to claim 1, comprising an overpressure sensor and an oxygen-content sensor arranged in the flow channel for determining a time for cleaning the filter.

11. The refrigerated case according to claim 3, wherein the carrier comprises a front side and a gripping tab attached to an upper end of the front side of the carrier.

12. The refrigerated case according to claim 1, comprising at least one fan disposed in the rear end region of the circulation channel upstream of the filter in a direction of the air current and proximate to the filter.

13. The refrigerated case according to claim 12, wherein the fan pivots about a pivoting axis that extends in a longitudinal direction of the case, through the exit opening to a position at which at least a part of the fan is out of the circulation channel.

14. The refrigerated case according to claim 12, comprising a vaporizer located in the rear end region of the circulation channel, wherein the fan is disposed between the filter and the vaporizer.

* * * * *